US012798732B2

(12) United States Patent
Yoshida

(10) Patent No.: US 12,798,732 B2
(45) Date of Patent: Nov. 17, 2026

(54) FENDER FOR SHIPS

(71) Applicant: SAKINAGA KAIUN KABUSHIKI KAISHA, Nagasaki (JP)

(72) Inventor: Norifumi Yoshida, Nagasaki (JP)

(73) Assignee: SAKINAGA KAIUN KABUSHIKI KAISHA, Nagasaki (JP)

( * ) Notice: Subject to any disclaimer, the term of this patent is extended or adjusted under 35 U.S.C. 154(b) by 254 days.

(21) Appl. No.: 18/712,432

(22) PCT Filed: Nov. 11, 2022

(86) PCT No.: PCT/JP2022/042078

§ 371 (c)(1),
(2) Date: May 22, 2024

(87) PCT Pub. No.: WO2023/095644

PCT Pub. Date: Jun. 1, 2023

(65) Prior Publication Data

US 2025/0010960 A1 Jan. 9, 2025

(30) Foreign Application Priority Data

Nov. 24, 2021 (JP) ..... 2021-190113

(51) Int. Cl.
*B63B 59/02* (2006.01)
*B63B 21/56* (2006.01)

(52) U.S. Cl.
CPC ..... *B63B 59/02* (2013.01); *B63B 21/56* (2013.01); *B63B 2021/563* (2013.01)

(58) Field of Classification Search
CPC .... B63B 59/02; B63B 21/56; B63B 2021/563
USPC ..... 114/219
See application file for complete search history.

(56) References Cited

U.S. PATENT DOCUMENTS

| | | | |
|---|---|---|---|
| 5,716,166 | A | 2/1998 | Phillips et al. |
| 10,294,048 | B2 | 5/2019 | Smith |
| 2015/0307160 | A1 | 10/2015 | Clarkson |
| 2021/0047013 | A1 | 2/2021 | Magnusson et al. |

FOREIGN PATENT DOCUMENTS

| | | | |
|---|---|---|---|
| CN | 210852801 | U | 6/2020 |
| EP | 2 298 641 | A2 | 3/2011 |
| JP | H7-33075 | A | 2/1995 |
| JP | 2016-515484 | A | 5/2016 |

OTHER PUBLICATIONS

ISR for PCT/JP2022/042078, dated Jan. 10, 2023 (w/ translation).
Office Action issued in INDIA Patent Appl. No. 202347079820, dated Jul. 22, 2026.

*Primary Examiner* — T. Scott Fix
(74) *Attorney, Agent, or Firm* — Greenblum & Bernstein, P.L.C.

(57) ABSTRACT

A fender for ships that includes: a structural body contact portion that is brought into contact with two poles of an offshore structural body so as to protect a ship when the ship is brought alongside the offshore structural body provided with two poles; a ball joint portion that supports the structural body contact portion on the ship; and a rear buffer portion disposed behind the structural body contact portion.

13 Claims, 7 Drawing Sheets

FENDER FOR SHIPS

TECHNICAL FIELD

The present invention relates to a fender for ships used for a ship that is brought alongside an offshore structural body such as an offshore wind power generation facility, for example.

BACKGROUND ART

To cope with global warming and to improve an energy self-sufficiency rate, the expectation for renewable energy has been increased. Particularly, in our country that is a maritime country, the expectation for the future development of a maritime power generation business has been increased.

In an offshore wind power generation that is one of power generations on the ocean, the maintenance an offshore wind power generation facility is considered as a key that ensures an operating ratio of the facility (power generation amount). However, an operation of bringing an access ship alongside the offshore wind power generation facility is largely influenced by a weather on a sea and hence, it is not easy to perform the maintenance stably and safely. In view of such circumstances, to bring the access ship alongside the offshore wind power generation facility more stably, studies have been made with respect to a fender that is brought into contact with the offshore wind power generation facility when the access ship is brought alongside the offshore wind power generation facility.

As such a fender for ships, for example, there has been known a fender for ships that has the structure adopted by a ship suitable for cruising provided for anchoring the ship to a pair of pylon (poles). The fender includes a layer made of a compressive material and having an exposed surface (see patent literature 1).

CITATION LIST

Patent Literature

Patent Literature 1: Japanese Unexamined Patent Application Publication (Translation of PCT Application) No. 2016-515484

SUMMARY OF INVENTION

Technical Problem

It is an object of the present invention to provide a fender for ships that can bring the fender for ships alongside an offshore structural body stably and safely with a simple structure.

Solution to Problem

The inventors of the present invention have made extensive studies to overcome the above-mentioned drawbacks, and as a result of the studies, the inventors have found that a fender for ships that includes: a structural body contact portion that is brought into contact with a pole of an offshore body; a ball joint portion that supports the structural body contact portion on a ship; and a rear buffer portion disposed behind the structural body contact portion, can overcome the above-mentioned drawback, and have completed the present invention.

That is, the present invention is as follows.

[1] A fender for ships that is mounted on a ship that is brought alongside an offshore structural body, the fender for ships comprising:

- a structural body contact portion that is brought into contact with a pole of the offshore structural body;
- a ball joint portion that supports the structural body contact portion disposed on the ship; and
- a rear buffer portion that is disposed behind the structural body contact portion.

[2] The fender for ships according to [1], wherein the structural body contact portion includes: a center support portion that is supported on the ship by the ball joint portion; and both wing portions that are rotatably disposed in a back and forth direction on left and right sides of the center support portion, and each have a front surface that is brought into contact with the pole of the offshore structural body, and

- the rear buffer portion is disposed behind both wing portions of the structural body contact portion.

[3] The fender for ships according to [2], wherein the both wing portions each include a pole holding recessed portion for holding the pole on the offshore structural body on a front surface thereof.

[4] The fender for ships according to [3], wherein the both wing portions each include a pushing support portion that is disposed adjacently to a center support portion side of a pole holding recessed portion, and supports by pushing the pole that is fitted in the pole holding recessed portion.

[5] The fender for ships according to [3] or [4], wherein the pole holding recessed portion has an arcuate shape, and a pole contact surface of the pushing support portion is disposed on a more pole holding recessed portion center side than an arcuate imaginary extension of the pole holding recessed portion.

[6] The fender for ships according to any one of [1] to [5], further comprising a connecting member that connects the both wing portions and the ship to each other.

[7] The fender for ships according to any one of [2] to [6], wherein the rear buffer portion includes a first rear buffer portion and a second rear buffer portion having higher elasticity than the first rear buffer portion, and

- the first rear buffer portion and the second rear buffer portion are brought into contact with rear surfaces of the both wing portions of the structural body contact portion so as to support the both wing portions when the ship is brought into contact with the pole of the offshore structural body.

[8] The fender for ships according to any one of [1] to [7], wherein the rear buffer portion includes a first rear buffer portion made of a ring-shaped buffer member.

[9] The fender for ships according to [8], wherein the ring-shaped buffer member is a rubber tire.

[10] The fender for ships according to [8] or [9], wherein the second rear buffer portion is disposed inside the ring of the ring-shaped buffer member.

[11] The fender for ships according to any one of [1] to [10], wherein the ball joint portion includes;

- a ball stud provided with a stud portion and a ball portion connected to the stud portion;
- a socket configured to house the ball portion of the ball stud therein; and
- a socket configured to house the ball portion of the ball stud therein in a spherical surface contact state, and being tiltably connected to the ball stud.

[12] The fender for ships according to any one of [2] to [11], wherein the fender for ships is a fender for ships mounted on a ship that makes a non-self-cruising ship cruise by pushing, and the structural body contact portion further includes: a center buffer portion disposed on a front surface of the center support portion, and both end buffer portions disposed on outer end portions of the both wing portions.

[13] The fender for ships according to [12], wherein the both end buffer portions are roller fenders.

[14] A ship comprising the fender for ships according to any one of [1] to [13].

[15] The ship according to [14], wherein the ship is used for getting access to an offshore wind power generation facility and for allowing the ship to cruise to the offshore wind power generation facility by pushing.

[16] A fender for ships mounted on a ship that makes a non-self-cruising type ship cruise by pushing, the fender for ships comprising;

a structural body contact portion being brought into contact with the non-self-cruising type ship;

a ball joint portion that supports the structural body contact portion on the ship; and a rear buffer portion disposed behind the structural body contact portion, wherein the structural body contact portion includes: a center support portion that is supported on the ship by the ball joint portion; both wing portions that are rotatably disposed in a back and forth direction on left and right sides of the center support portion; a center buffer portion disposed on a front surface of the center support portion; and both end buffer portions disposed on outer end portions of the both wing portions.

Advantageous Effects of Invention

The fenders for ships according to the present invention can be brought alongside an offshore structural body stably and safely with a simple structure.

DESCRIPTION OF EMBODIMENTS

Figure 1:
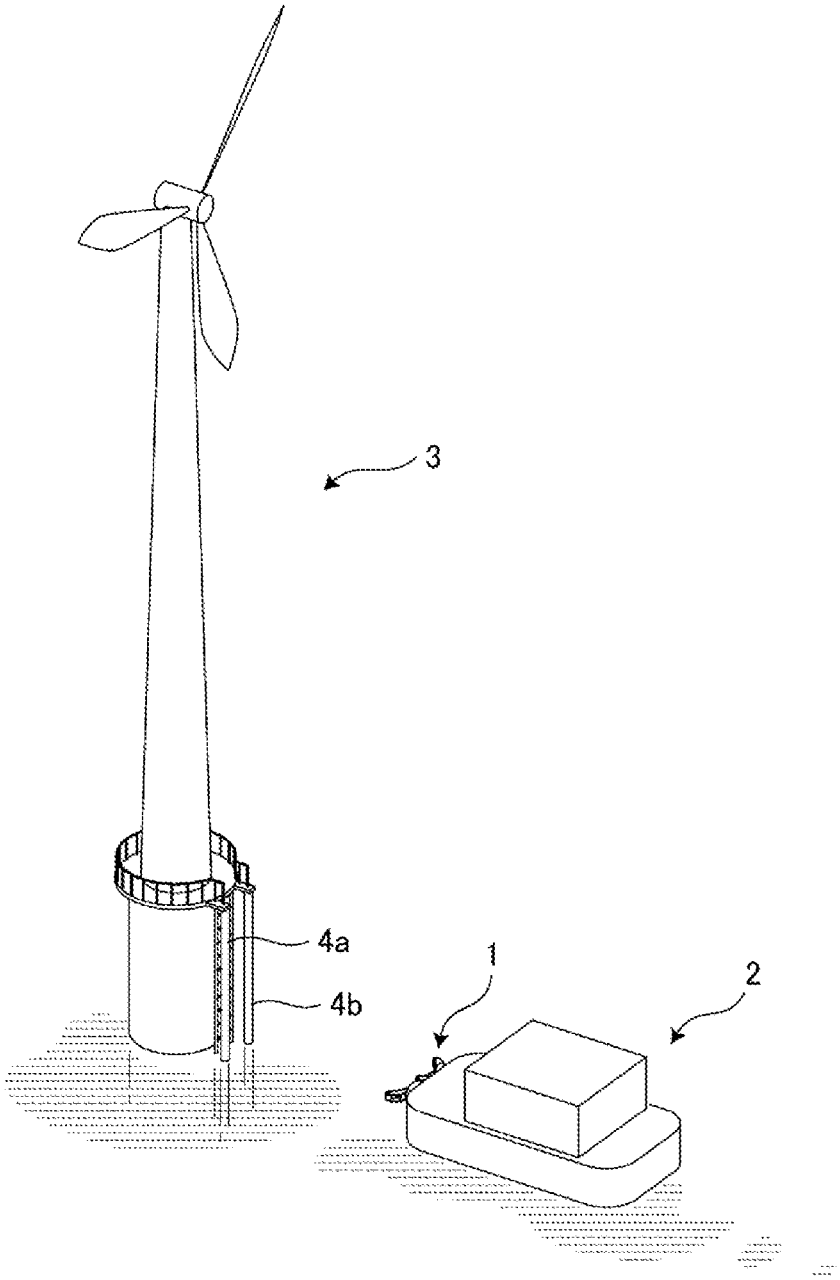
FIG. 1 is a view illustrating the manner of bringing a ship provided with a fender for ships according to a first embodiment of the present invention alongside an offshore wind power generation facility.

The fender for ships according to the present invention is a fender for ships that is mounted on a ship that is brought alongside an offshore structural body, wherein the fender for ships includes: a structural body contact portion that is brought into contact with a pole of the offshore structural body; a ball joint portion that supports the structural body contact portion disposed on the ship; and a rear buffer portion that is disposed behind the structural body contact portion.

In the fender for ships according to the present invention, the fender for ships can be brought alongside the offshore structural body such as the offshore wind power generation facility stably and safely with the simple configuration. At the time of bringing the fender for ships alongside the offshore structural body by bringing a structural body contact portion into contact with the offshore structural body, the ball joint portion supports the structural body contact portion. Accordingly, structural body contact portion is operated flexibly. Accordingly, a state where the fender (ship) is brought into contact with the pole of the offshore structural body is stably maintained and hence, rocking of the ship can be suppressed. At the same time, a rear surface of the structural body contact portion is brought into contact with a rear buffer portion and hence, the rear buffer portion absorbs and attenuates an impact to the structural body contact portion. Because of these operations, the fender for ships can be brought along the offshore structural body stably and safely. Further, the fender for ships uses a mechanical control and hence, the manufacture and the maintenance can be performed easily and at a low cost.

As a ship on which the fender for ships according to the present invention is installed, specifically, an access ship (a transfer ship) that transfers persons to the offshore wind power generation facility can be named. A place where the fender for ships is installed on the ship is not particularly limited. The installation place may be any one of a bow side, a stern side, a ship side and the like. However, usually, the fender for ships is installed on the bow side.

Hereinafter, in this specification, the description is made based on a state where the fender for ships according to the present invention is installed on the bow side of the ship. Further, in a state where a ship provided with the fender for ships according to the present invention is brought alongside the offshore structural body, an offshore structural body side may be also referred to as a front side, and a ship side may be also referred to as a rear side.

[Structural Body Contact Portion]

The structural body contact portion is a portion that is brought into contact with a pole of the offshore structural body when the fender of ships is brought alongside the offshore structural body. The pole of the offshore structural body is a birthing member or a fender member for bringing a ship alongside the offshore structural body (bringing the ship ashore the offshore structural body). The pole is usually installed in the form of one set (two poles). The structural body contact portion may be a structural body contact portion provided with protective materials that protects surfaces brought into contact with the poles of the offshore structural body. As the protective material, for example, a coating agent applied to the surface by coating, a cushion member mounted on the surface and the like are named.

As a preferred mode of the structural body contact portion, it is possible to name a mode where the structural body contact portion includes: a center support portion that is supported on the ship by the ball joint portion; and both wing portions that are disposed on left and right sides of the center support portion in a rotatable manner in a back and forth direction and has front surfaces thereof that are brought into contact with the poles of the offshore structural body, wherein a rear buffer portion is disposed behind both wing portions of the structural body contact portion. In the case where this mode is adopted, when the ship is brought into contact with the poles of the offshore structural body, rear surfaces of both wing portions of the offshore structural body contact portion are supported by the rear buffer portions.

(Center Support Portion and Both Wing Portions)

The center support portion is a portion that is positioned at the center of the structural body contact portion, and is supported on the ship by the ball joint portion. Both wing portions are portions that are disposed on the left and right sides of the center support portion in a rotatable manner in a back and forth direction, and have front surfaces that are brought into contact with the poles of the offshore structural body. It is preferable that the entirety of the front surfaces of the respective both wing portions be formed in an arcuate shape. Further, it is preferable that pole holding recessed portions that hold the poles of the offshore structural body be formed on portions of the front surfaces of the respective wing portions. When the ship is brought into contact with the poles of the offshore structural body, both wing portions of the structural body contact portion are spread so that the poles of the offshore structural body are fitted into the respective pole holding recessed portions of both wing portions. Accordingly, the front surfaces of the both wing portions of the structural body contact portions are pushed by the poles and, at the same time, the rear surfaces of both wing portions of the structural body contact portions are supported by the rear buffer portions, and both wing portions are held in a horizontally spread state (a state where both wing portions are opened). As a mode where both wing portions are rotated in a back and forth direction, the following modes are considered, for example. That is, a mode where both wing portions are rotated within a predetermined angular range in front of the state where both wing portions are spread horizontally, and a mode where both wing portions are rotated within an angular range from the state in front of the state where both wing portions are spread horizontally to the state where both wing portions are spread horizontally, are named.

As the shape of the pole holding recessed portion, an arcuate shape is preferable. It is preferable that a depth of the pole holding recessed portion having an arcuate shape be a depth that allows the pole holding recessed portion to accommodate a portion of the pole of the offshore structural body, that is, ⅕ or more of the diameter of the pole. It is more preferable that such an accommodating depth be ¼ or more of the diameter of the pole, and it is more preferable that such an accommodating depth be ⅓ or more of the diameter of the pole.

Further, it is preferable that both wing portions include pushing support portions that are disposed adjacently to a center support portion sides of the pole holding recessed portions and support by pushing the poles fitted in the pole holding recessed portions. More specifically, the pushing support portion is a portion that is disposed on a more pole holding recessed portion center side than an arcuate imaginary extension line of the pole holding recessed portion, and has a pole contact surface having a straight-line shape or an arcuate shape. With the provision of the pushing support portions, when a ship is brought into contact with the poles of the offshore structural body and both wing portions of the structural body contact portion are spread, the pushing support portions push the poles by the pole contact surfaces toward a shipside and hence, a pole gripping force is increased. It is preferable that the pushing support portion include a buffer material on a contact surface thereof for increasing the alleviation of an impact and the increase of gripping force when the ship is brought into contact with the poles. As a buffering material, a rubber fender is preferable. More specifically, a D-type rubber fender (a D-type fender member) can be named.

[Ball Joint Portion]

The ball joint portion is not particularly limited provided that the ball joint portion can support the structural body contact portion. As the ball joint portion, a ball joint portion that includes: a ball stud that has a stud portion and a ball portion connected to the stud portion; and a socket that accommodates the ball portion of the ball stud therein in a spherical face contact state and is tiltably connected to the ball stud can be exemplified. As an installation mode of the ball joint portion, a mode where the ball stud is fixed to the ship and the socket is fixed to the structural body contact portion may be adopted, or a mode where the ball stud is fixed to the structural body contact portion and the socket is fixed to the ship may be adopted. However, the former mode is preferable. With such a compact and simple configuration, the structural body contact portion can be supported flexibly in any directions consisting of a yaw direction, a rolling direction, and a pitching direction. Accordingly, a state where the fender (ship) is brought into contact with the poles of the offshore structural body can be stably held and hence, rocking of the ship can be suppressed. Further, in a case of a mode where the structural body contact portion includes the center support portion and both wing portions, the ball joint portion supports the center support portion of the structural body contact portion and hence, a propulsive force of the ship can be uniformly transmitted to both wing portions.

(Ball Stud)

The ball stud includes: the stud portion; and the spherical ball portion that is connected to the stud portion. A material of the ball stud is not particularly limited. For example, as the material of the ball stud, metal, a synthetic resin, and the like can be named. However, metal is preferable. The size of the ball portion can be suitably set depending on the size of the ship (structural body contact portion) or the like. For example, a diameter of the ball portion may be 60 mm to 1500 mm, more preferably be 60 mm to 1000 mm, and still more preferably be 80 mm to 500 mm, and still further more preferably be 100 mm to 200 mm.

(Socket)

The socket accommodates the ball portion of the ball stud therein in a spherical face contact state so as to connect the socket to the ball stud tiltably. The material of the socket is not particularly limited. For example, as the material of the socket, a synthetic resin, metal, natural rubber, wood, the combination of these materials and the like are named. A synthetic resin, metal, or the combination of a synthetic resin and metal are preferable.

[Rear Buffer Portion]

The rear buffer portion is a portion that is disposed behind the structural body contact portion and supports the structural body contact portion that is brought into contact with the poles of the offshore structural body. In a case where the structural body contact portion is in a mode where the structural body contact portion includes the above-mentioned center support portion and both wing portions, it is preferable that the rear buffer portion be disposed behind both wing portions of the structural body contact portion. It is sufficient that the rear buffer portion is disposed behind the structural body contact portion. That is, the rear buffer portion may not be disposed on the ship, or may be directly mounted on a rear portion of the structural body contact portion (both wing portions of the structural body contact portion).

The rear buffer portion is formed of a cushion member (a buffer member) such as an elastic body that reduces an impact. For example, as a material of the rear buffer portion, for example, rubber, a synthetic resin (a urethane resin, a nylon resin or the like), a spring and the like can be named. As the rear buffer portion of the fender for ships according to the present invention, rear buffer portions having various shapes can be adopted. However, the rear buffer portion having a ring shape is preferable. For example, it is preferable to adopt a rubber tire and a circular cylindrical fender (a cell fender) that are used as a fender member or a buffer member on a periphery of the ship. That is, it is preferable that the fender for ships according to the present invention include a first rear buffer portion made of a ring-shaped buffer member such as a rubber tire. As the sizes of the ring-shaped buffer member, for example, the diameter of the ring-shaped buffer member may preferably be 300 to 3000 mm, may more preferably be 600 mm to 1500 mm, may still more preferably be 800 mm to 1200 mm. The thickness (the width) of the ring-shaped buffer member may preferably be 100 mm to 1000 mm, may more preferably be 200 mm to 700 mm, may still more preferably be 300 mm to 500 mm.

It is preferable that the rear buffer portion is formed of a plurality of rear buffer portions. More specifically, as a preferred mode, for example, a mode can be exemplified where the rear buffer portion includes: the first rear buffer portion and a second rear buffer portion having higher modulus of elasticity than the first rear buffer portion, and when the ship is brought into contact with the poles of the offshore structural body, the first rear buffer portion and the second rear buffer portion are brought into contact with rear surfaces of both wing portions of the offshore structural body contact portion and support both wing portions. As the first rear buffer portion and the second rear buffer portion that can be adopted by the above-mentioned mode, for example, the first rear buffer portion having a large length in a back-and-forth direction and the second rear buffer portion having a shorter length than the first rear buffer portion in a back-and-forth direction can be named. For example, it is preferable to adopt a mode where the first rear buffer portion be formed of a ring-shaped buffer member, and the second rear buffer portion be formed of a buffer member that is disposed inside the ring-shaped buffer member.

In the fender for ships according to the present invention, it is preferable that the structural body contact portion further include: a center buffer portion that is disposed on a front surface of the center support portion; and both end buffer portions that are disposed on outer side end portions of both wing portions. With such a configuration, it is possible to bring the fender for ships into contact with a wall surface (flat wall surface) of the structural body at three portions consisting of the center buffer portion and both end buffer portions of the structural body contact portion. Accordingly, it is possible to make the structural body arrive at (reach) the wall surface and to move the offshore structural body. As the structural body having the wall surface, for example, an offshore wind power generation facility, a non-self-cruising type ship (a barge, an earth carrier or the like), a shore facility (a harbor, a coastal levee or the like) can be named.

In a case of the above-mentioned mode where the fender for ships has the center buffer portion and both end buffer portions of the structural body contact portion, the mode is effective in pushing a non-self-cruising ship. In pushing the non-self-cruising ship that forms a ship, the center buffer portion and both end buffer portions of the structural body contact portion are brought into contact with the wall surface of the non-self-cruising ship so that stable pushing of the ship can be realized. The fender for ships according to the present invention is useful in making the ship get access to the offshore wind power generation facility and/or pushing the ship. Accordingly, the ship provided with the fender for ships according to the present invention can be used for making the ship get access to the offshore wind power generation facility and/or for pushing the ship.

(Center Buffer Portion and Both End Buffer Portion)

The center buffer portion and both end buffer portions of the structural body contact portion are cushion members (buffer members) that reduce an impact when the ship is brought into contact with the wall surface of the offshore structural body. As a material of the cushion member, for example, rubber, a sponge, a synthetic resin (a urethane resin, a nylon resin or the like) and the like can be named. Further, it is preferable that the center buffer portion and both end buffer portions be disposed in a straight-line shape (in parallel to the wall surface) in a state where both end buffer portions spread horizontally (in an open state). Both end buffer portions preferably be each formed of a roller fender. By bringing the roller fenders into contact with the wall surface of the offshore structural body, a load applied to the ship can be reduced and, at the same time, both wing portions can be easily spread and hence, the ship can be efficiently supported by bringing the ship into contact with the wall surface of the offshore structural body at three portions consisting of the center buffer portion and both end buffer portions thereof. Further, the above-mentioned configuration can cope with the lateral movement of the ship.

[Connecting Member]

It is preferable that the fender for ships according to the present invention include a connecting member that connects the ship and the both wing portions to each other. As the connecting member, for example, ropes, metal chains and the like can be named. With such a configuration, before the ship is brought into contact with the poles of the offshore structural body, the connecting member pulls the both wing portions of the structural body contact portion to a rear buffer portion side with a suitable force and hence, a state can be obtained where the rocking of the structural body contact portion in a yaw direction, in a rolling direction and in a pitching direction" can be suppressed. On the other hand, after the ship is brought into contact with the poles of the offshore structural body, the connecting members is brought into a slackened state and hence, it is possible to allow the structural body contact portion to take a state where structural body contact portion is movable flexibly in a yaw direction, in a rolling direction and in a pitching direction.

Next, the manner of use (the manner of operation) of the fender for ships according to the present invention is described.

In the fender for ships according to the present invention, at the time of bringing the ship alongside the offshore structural body, the structural body contact portion is brought into contact with the poles disposed on the offshore structural body, and the structural body contact portion that is brought into contact with the poles is supported by the rear buffer portions disposed behind the structural body contact portion. Accordingly, the structural body contact portion can be brought alongside the offshore structural body stably by attenuating an impact applied to the ship. Further, the ball joint portion supports the structural body contact portion and hence, the structural body contact portion is operated flexibly in all directions of a yaw direction, a rolling direction and a pitching direction and hence, a state where the fender (ship) is brought into contact with the poles of the offshore structural body can be held stably and hence, rocking of the ship can be suppressed.

Further, in a case where the structural body contact portion includes the center buffer portion and the both wing portions that are rotatably disposed on left and right sides of the center buffer portion in a back-and-forth direction, and the rear buffer portions are disposed behind the both wing portions of the structural body contact portion, by bringing the ship alongside the offshore structural body, by bringing the front surfaces of both wing portions of the structural body contact portion into contact with poles that the offshore structural body includes, and by supporting the rear surfaces of both wing portions of the structural body contact portion in a contact state by the rear buffer portions, the ship can be stably brought alongside the offshore structural body while attenuating an impact applied to the ship.

Further, in a case where the structural body contact portion further includes: the center buffer portion that is formed on a front surface of the center support portion; and both end buffer portions disposed on the outer end portions of both wing portions, at the time of making the ship arrive at (reach) the structural body or at the time of moving the structural body, it is possible to alleviate an impact to the ship. Such alleviation of the impact can be made possible by bringing the center buffer portion and both end buffer portions of the structural body contact portion into contact with the wall surface of the structural body, and by allowing the rear buffer portions disposed behind the structural body contact portion that is brought into contact with the wall surface of the structural body to support the structural body contact portion.

A fender for ships according to a second embodiment of the present invention is a fender for ships mounted on a ship that makes a non-self-cruising type ship cruise by pushing. The fender for ships according to the second embodiment is characterized by including: a structural body contact portion being brought into contact with the non-self-cruising type ship; a ball joint portion that supports the structural body contact portion on the ship; and a rear buffer portion disposed behind the structural body contact portion, wherein the structural body contact portion includes: a center support portion that is supported on the ship by the ball joint portion: both wing portions that are rotatably disposed in a back and forth direction on left and right sides of the center support portion; a center buffer portion disposed on a front surface of the center support portion; and both end buffer portions disposed on outer end portions of the both wing portions. The respective members that are used in the fender for ships according to the second embodiment have substantially the same configurations as the (first) fender for ships according to the present invention described above and hence, the description of these configurations is omitted.

Hereinafter, an embodiment of a fender for ships according to the present invention will be described specifically with reference to drawings. However, the present invention is not limited to the embodiment.

Figure 2:
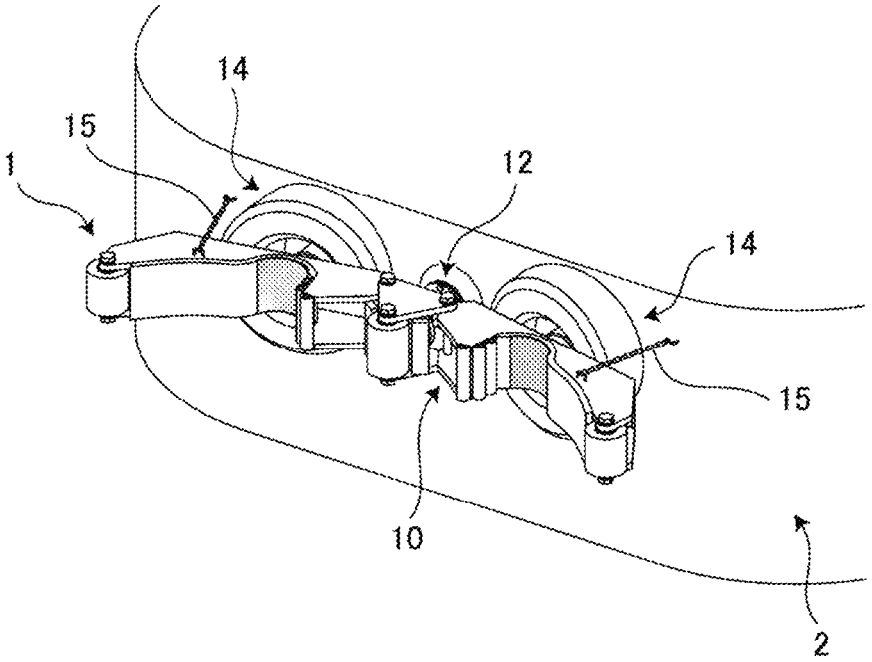
FIGS. 2(*a*) and 2(*b*) are front perspective views of the fender for ships according to the first embodiment of the present invention, wherein FIG. 2(*a*) illustrates a state before the fender for ships is brought alongside the offshore wind power generation facility, and FIG. 2(*b*) illustrates a state where the fender for ships has been brought alongside the offshore wind power generation facility.
Figure 2:
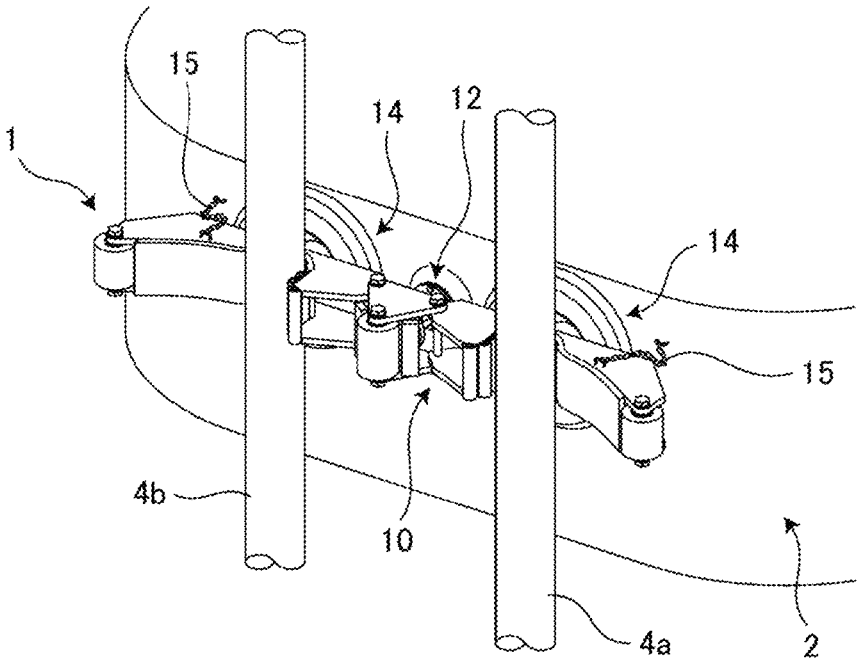
Figure 3:
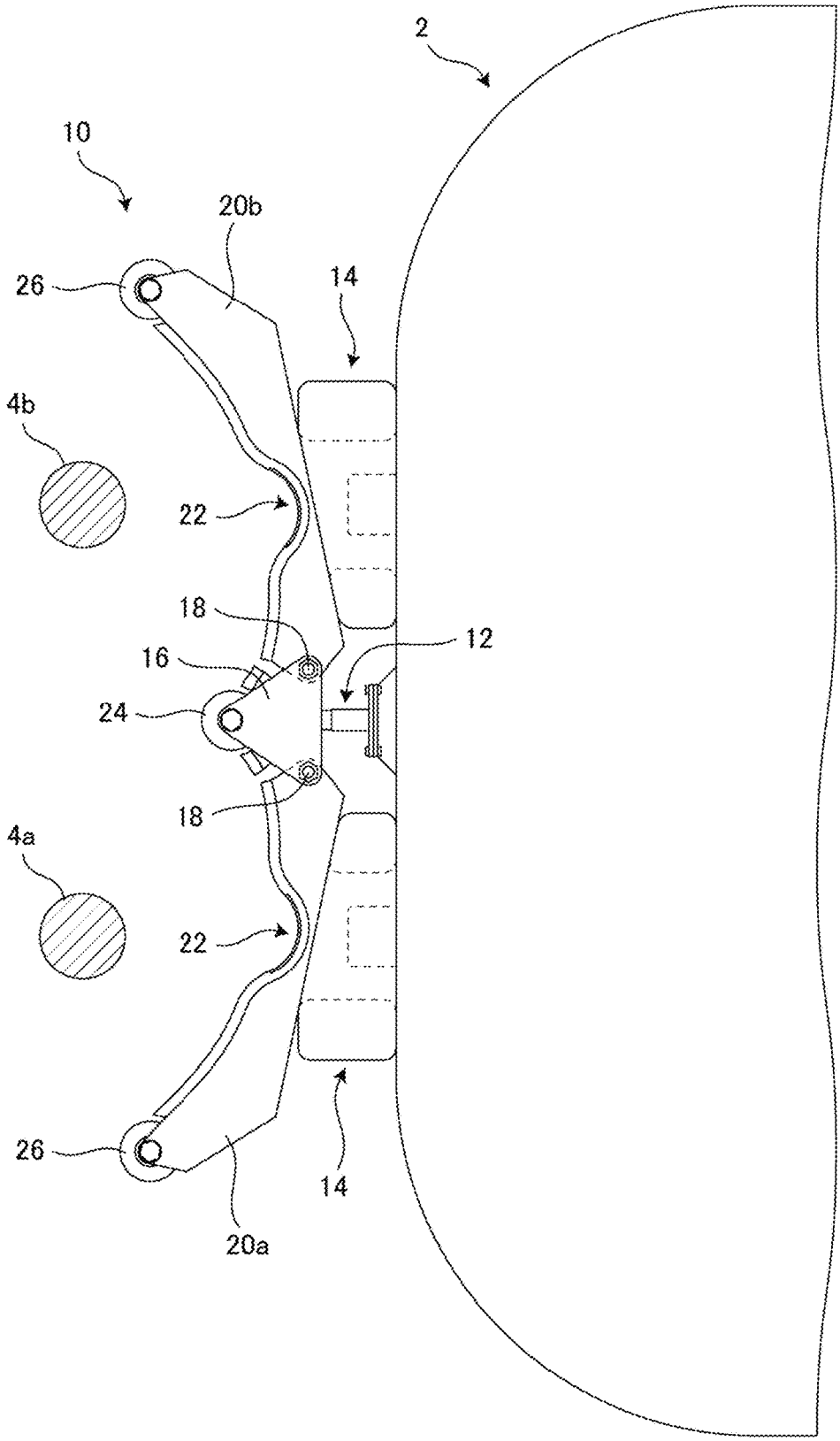
FIG. 3 is a plan view of the fender for ships according to the first embodiment of the present invention.
Figure 4:
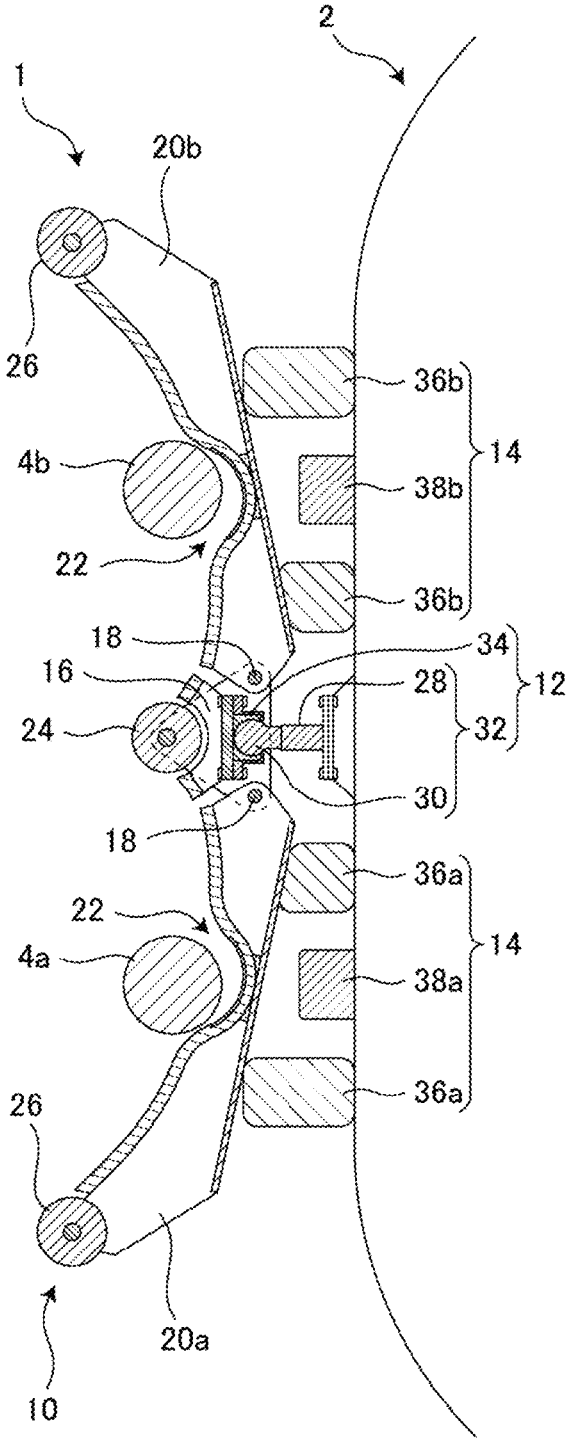
FIGS. 4(*a*) and 4(*b*) are center cross-sectional views of the fender for ships according to the first embodiment of the present invention, wherein FIG. 4(*a*) illustrates a state immediately before the fender for ships is brought alongside the offshore wind power generation facility, and FIG. 4(*b*) illustrates a state where the fender for ships has been brought alongside the offshore wind power generation facility.
Figure 4:
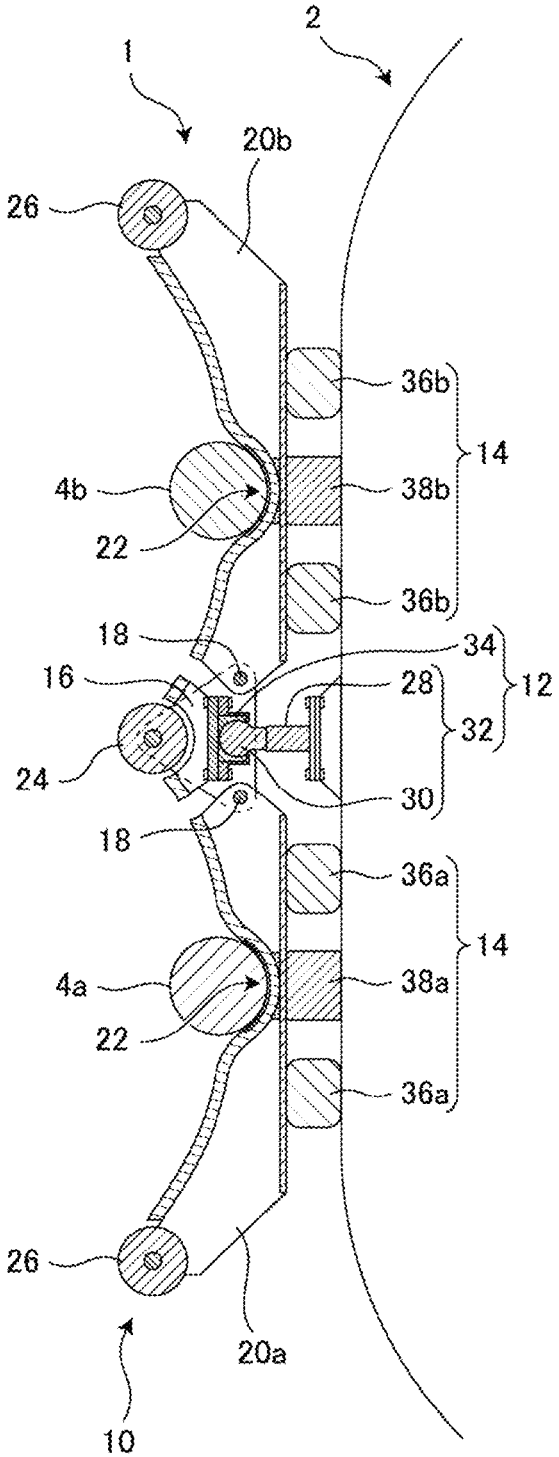
Figure 5:
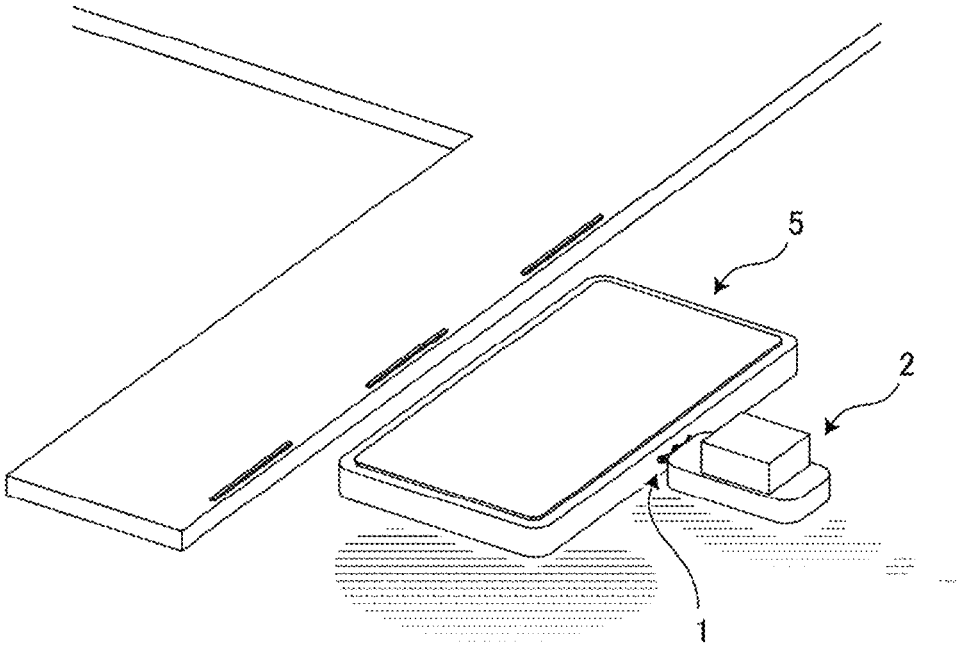
FIG. 5 illustrates a state where a ship provided with the fender for ships according to the first embodiment of the present invention pushes a non-self-cruising type ship.
Figure 6:
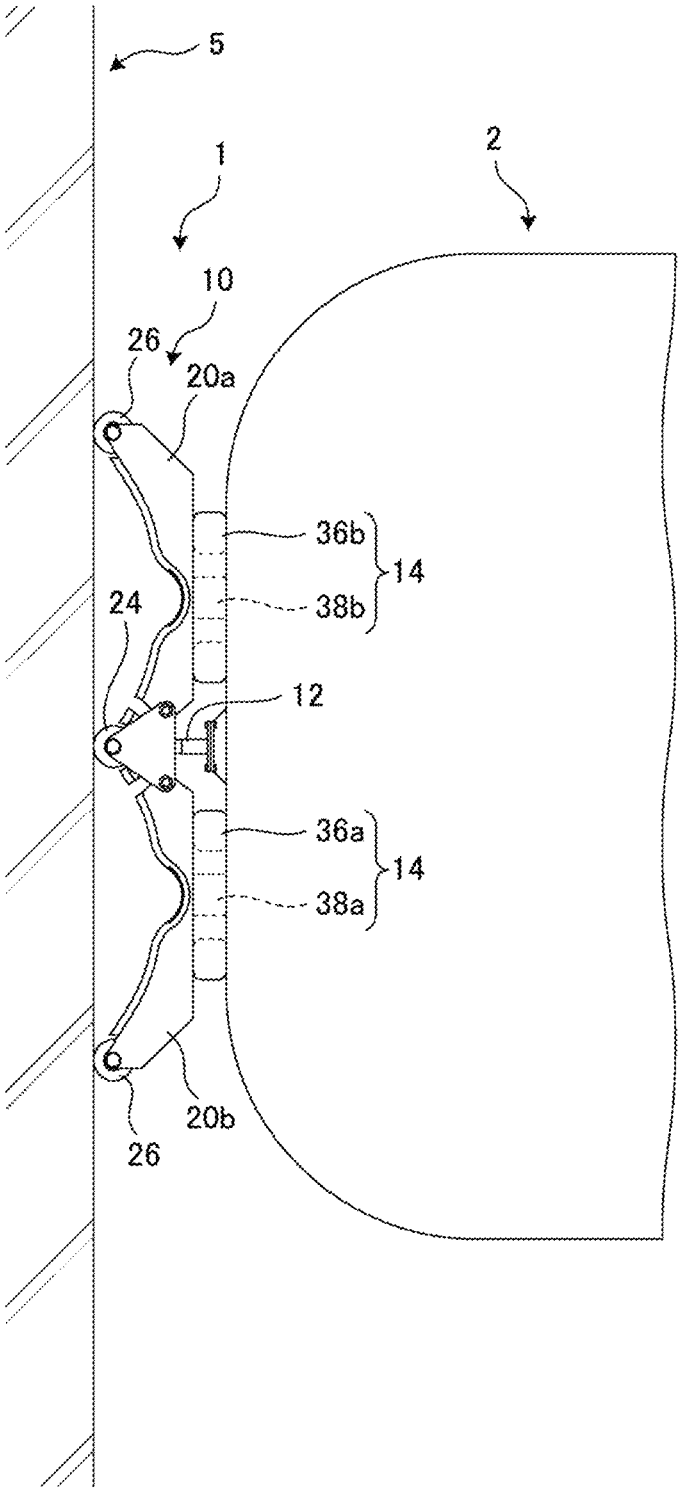
FIG. 6 is a schematic plan view of the fender for ships according to the first embodiment of the present invention, and illustrates a state when the non-self-cruising type ship has been pushed.

In the first embodiment, FIG. 1 is a view illustrating the manner of bringing a ship provided with a fender for ships according to a first embodiment of the present invention alongside an offshore wind power generation facility. FIG. 2 is a front perspective view of the fender for ships according to the first embodiment of the present invention, wherein FIG. 2(*a*) illustrates a state before the fender for ships is brought alongside the offshore wind power generation facility, and FIG. 2(*b*) illustrates a state where the fender for ships has been brought alongside the offshore wind power generation facility. FIG. 3 is a plan view of the fender for ships according to the first embodiment of the present invention. FIG. 4 is a center cross-sectional view of the fender for ships according to the first embodiment of the present invention, wherein FIG. 4(*a*) illustrates a state immediately before the fender for ships is brought alongside the offshore wind power generation facility, and FIG. 4(*b*) illustrates a state where the fender for ships has been brought alongside the offshore wind power generation facility. FIG. 5 illustrates a state where a ship provided with the fender for ships according to the first embodiment of the present invention pushes a non-self-cruising type ship. FIG. 6 is a schematic plan view of the fender for ships according to the first embodiment of the present invention, and illustrates a state when the non-self-cruising type ship has been pushed. The drawings that are referenced in the embodiment are described schematically for facilitating the understanding of the present invention. For example, there may be a case where the ratios of sizes of objects depicted in the drawing differ from ratios of sizes of actual objects.

As illustrated in FIG. 1, a fender for ships 1 according to a first embodiment of the present invention is mounted on a bow side of an access ship 2, and allows the access ship 2 to be brought alongside an offshore wind power generation facility 3 stably and safely.

As illustrated in FIG. 2, the fender for ships 1 according to the first embodiment of the present invention includes: a structural body contact portion 10 that is brought into contact with a set of poles (pier members) 4*a*, 4*b* of the offshore wind power generation facility 3; a ball joint portion 12 that supports the structural body contact portion 10 on the access ship 2; and rear-side buffer portions 14 that are disposed behind the structural body contact portion 10.

As illustrated in FIG. 3, the structural body contact portion 10 includes: a center support portion 16 that is supported on the access ship 2 by the ball joint portion 12; and both wing portions 20*a*, 20*b* that are connected to left and right sides of the center support portion 16 by hinge joints 18 so as to be rotatable in a back-and-forth direction. Both wing portions 20*a*, 20*b* are each formed such that the entirety of a front surface of the both wing portion 20*a*, 20*b* is formed in an arcuate shape, and a pole holding recessed portion 22 that holds the pole 4*a*, 4*b* of the offshore wind power generation facility 3 is formed on a portion of the front surface of the both wing portion 20*a*, 20*b*. A coating agent made of a polyurea resin is applied by coating to surfaces of the center support portion 16 and both wing portions 20*a*, 20*b* as a protective material. Further, a cushion plate made of rubber is mounted on a surface of the pole holding recessed portion 22.

Further, the structural body contact portion 10 includes: a center buffer portion 24 made of rubber that is mounted on a front surface of the center support portion 16; and roller fenders 26 that are mounted on outer end portions of both wing portions 20*a*, 20*b* as both end buffer portions.

As illustrated in FIG. 4, the ball joint portion 12 includes: a ball stud 32 having a rod-shaped stud portion 28 made of metal, and a spherical ball portion 30 made of metal that is connected to the stud portion 28; and a socket 34 that accommodates the ball portion 30 of the ball stud 32 therein in a spherical surface contact state, and is tiltably connected to the ball stud 32. The ball joint portion 12 is fixed to the access ship 2, and the socket 34 is fixed to the center support portion 16.

As illustrated in FIG. 4, the rear buffer portions 14 include: rubber tires (first rear buffer portions) 36*a*, 36*b* disposed behind both wing portions 20*a*, 20*b* of the structural body contact portion 10; and high elastic rubbers (second rear buffer portions) 38*a*, 38*b* disposed in rings of the rubber tires 36*a*, 36*b* and having higher elasticity than rubber tires 36*a*, 36*b*.

As illustrated in FIG. 2, the fender for ships 1 according to the first embodiment of the present invention includes metal chains 15 as connecting members that connect the access ship 2 and both wing portions 20*a*, 20*b* and pull both wing portions 20*a*, 20*b* to an access ship 2 side. As illustrated in FIG. 2(*a*), before the access ship 2 is brought into contact with poles 4*a*, 4*b* of the offshore wind power generation facility 3, the metal chains 15 pull both wing portions 20*a*, 20*b* of the structural body contact portion 10 toward the rear buffer portion 14 side with an appropriate force. Accordingly, the metal chains 15 suppress the rocking of the structural body contact portion 10 in all of a yaw direction, a rolling direction, and a pitching direction. On the other hand, as illustrated in FIG. 2(*b*), after the access ship 2 is brought into contact with the poles 4*a*, 4*b* of the offshore wind power generation facility 3, the metal chains 15 are brought into a slackened state and allow the structural body contact portion 10 to be flexibly operated in all of a yaw direction, a rolling direction, and a pitching direction.

Next, the manner of operation of the fender for ships 1 when a ship provided with the above-mentioned fender for ships 1 is brought alongside the offshore wind power generation facility 3 is described.

As illustrated in FIG. 4(*a*), in a state immediately before the access ship 2 approaches the offshore wind power generation facility 3 and is brought alongside the offshore wind power generation facility 3 (in a state where the fender for ships 1 is not brought into contact with the poles 4*a*, 4*b* of the offshore wind power generation facility 3), rear surfaces of both wing portions 20*a*, 20*b* of the structural body contact portion 10 are brought into contact with the rubber tires 36*a*, 36*b* of the rear buffer portions 14 and hence, a state where both wing portions 20*a*, 20*b* are inclined frontward (a state where both wing potions 20*a*, 20*b* are closed) is held. Since both wing portions 20*a*, 20*b* of the structural body contact portion 10 are brought into contact with the poles 4*a*, 4*b* of the offshore wind power generation facility 3 from the state where both wing portions 20*a*, 20*b* are inclined frontward, both wing portions 20*a*, 20*b* are spread, and the poles 4*a*, 4*b* are guided into the pole holding recessed portions 22 of both wing portions 20*a*, 20*b*.

Subsequently, as illustrated in FIG. 4(*b*), in a state where the access ship 2 is brought alongside the offshore wind power generation facility 3 (in a state where the fender for ships 1 is brought into contact with the poles 4*a*, 4*b* of the offshore wind power generation facility 3), front surfaces of both wing portions 20*a*, 20*b* of the structural body contact portion 10 are pushed to the poles 4*a*, 4*b* of the offshore wind power generation facility 3 held in the pole holding recessed portions 22 and, at the same time, rear surfaces of both wing portions 20*a*, 20*b* of the structural body contact portion 10 are supported by the rubber tires 36*a*, 36*b* and the high elastic rubbers 38*a*, 38*b* and hence, both wing portions 20*a*, 20*b* of the structural body contact portion 10 are brought into a state where both wing portions 20*a*, 20*b* are spread horizontally (in an open state).

Accordingly, the access ship 2 can be brought alongside the offshore wind power generation facility 3 stably.

Next, the manner of operation of the fender for ships 1 when the ship provided with the above-mentioned fender for ships 1 pushes a non-self-cruising type ship is described.

As illustrated in FIG. 5 and FIG. 6, in a state where the access ship 2 pushes the non-self-cruising type ship 5, the center buffer portion 24 and the roller fenders 26 are linearly brought into contact with a wall surface of the non-self-cruising ship 5. As a result, the center buffer portion 24 and the roller fenders 26 of the structural body contact portion 10 are pushed by a wall surface of the non-self-cruising type ship 5 and, at the same time, rear surfaces of both wing portions 20*a*, 20*b* of the structural body contact portion 10 are supported by the rubber tires 36*a*, 36*b* and the high elastic rubbers 38*a*, 38*b* and hence, both wing portions 20*a*, 20*b* of the structural body contact portion 10 are brought into a state where both wing portions 20*a*, 20*b* are spread horizontally (in an open state).

Accordingly, the access ship 2 can stably push the non-self-cruising type ship 5.

Subsequently, a fender for ships according to the second embodiment of the present invention is described in detail. This embodiment differs from the above-mentioned first embodiment with respect to a point that the fender for ships includes pushing force support portions that are disposed adjacently to center support portion sides of pole holding recessed portions of both wing portions, and support the poles that are fitted into pole holding recessed portions by pushing. With respect to configurational members substantially equal to the corresponding configurational members of the fender for ships 1 according to the above-mentioned first embodiment are given same symbols and the description of these constitutional members is omitted.

Figure 7:
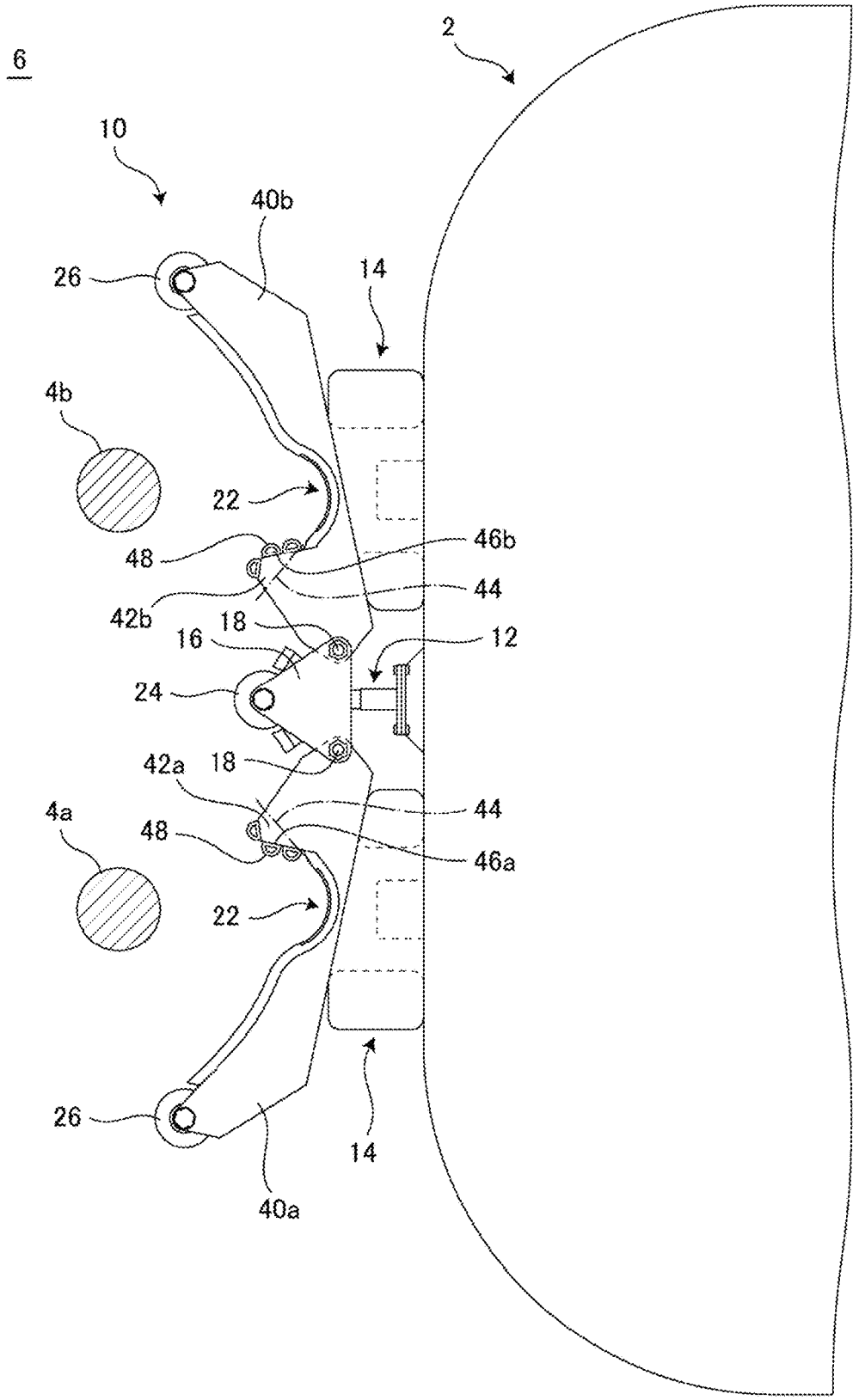
FIG. 7 is a plan view of a fender for ships according to a second embodiment of the present invention.

In the second embodiment, FIG. 7 is a plan view of the fender for ships according to the second embodiment of the present invention.

As illustrated in FIG. 7, in a fender for ships 6 according to the second embodiment, both wing portions 40*a*, 40*b* include pushing force support portions 42*a*, 42*b* that are disposed adjacently to center support portion 16 sides of the pole holding recessed portions 22, and support poles 4*a*, 4*b* fitted in the pole holding recessed portions 22 by pushing. The pushing support portions 42*a*, 42*b* are portions that have pole contact surfaces 46*a*, 46*b* having a straight-line shape disposed on a more pole holding recessed portion 22 center side than arcuate imaginary extensions 44 of the pole holding recessed portions 22. That is, the pole contact surfaces 46*a*, 46*b* are surfaces inclined slightly inward (toward a center support portion 16 side) than a direction perpendicular to a fender mounting surface of an access ship 2 (a ship advancing direction) before the poles 4*a*, 4*b* are held by the pole holding recessed portions 22. With such a configuration, the contacting of the poles 4*a*, 4*b* with the pole holding recessed portions 22 is not obstructed. Further, both wing portions 40*a*, 40*b* are spread after the poles 4*a*, 4*b* are held in the pole holding recessed portions 22 and hence, the pole contact surfaces 46*a*, 46*b* of the pushing support potions 42*a*, 42*b* are inclined toward a pole holding recessed portion 22 side. Accordingly, the pushing support portions 42*a*, 42*b* push the poles 4*a*, 4*b* fitted in the pole holding recessed portions 22 and hence, the poles 4*a*, 4*b* can be more firmly held. The pushing support portions 42*a*, 42*b* include D-type rubber fenders 48 that function as buffer materials on the pole contact surfaces 46*a*, 46*b*.

INDUSTRIAL APPLICABILITY

The fender for ships according to the present invention can be used as a fender for ships that is used for getting access to an offshore wind power generation facility and hence, the present invention is industrially useful.

REFERENCE SIGNS LIST

1: fender for ships (first embodiment)
2: access ship (ship)
3: offshore structural body
4*a*, 4*b*: pole (pier member)
5: non-self-cruising type ship
6: fender for ships (second embodiment)
10: structural body contact portion
12: ball joint portion
14: rear buffer portion
15: metal chains (connecting member)
16: center support portion
18: hinge joint
20*a*, 20*b*: both wing portions
22: pole holding recessed portion
24: center buffer portion
26: roller fender (both end buffer portion)
28: stud portion
30: ball portion
32: ball stud
34: socket
36*a*, 36*b*: rubber tire (first rear buffer portion)
38*a*, 38*b*: high elastic rubber (second rear buffer portion)
40*a*, 40*b*: both wing portions
42*a*, 42*b*: pushing support portion
44: arcuate imaginary extension
46*a*, 46*b*: pole contact surface
48: D-type rubber fender

The invention claimed is:

1. A fender for ships that is configured to be mounted on a ship that is brought alongside an offshore structural body, the fender for ships comprising:

a structural body contact portion configured to contact a pair of poles of the offshore structural body;

a ball joint portion that supports the structural body contact portion on the ship; and a rear buffer portion that is disposed behind the structural body contact portion, wherein the structural body contact portion includes: a center support portion that is supported on the ship by the ball joint portion; and wing portions that are rotatably disposed in a back and forth direction on left and right sides of the center support portion, the wing portions each having a front surface that is configured to contact one of the pair of poles of the offshore structural body, the wing portions each including, on the front surface thereof, a pole holding recessed portion configured to hold one of the pair of poles of the offshore structural body, and the rear buffer portion is disposed behind the wing portions of the structural body contact portion.

2. The fender for ships according to claim 1, wherein the wing portions each include a pushing support portion that is disposed adjacently to a center support portion side of the pole holding recessed portion, and supports by pushing one of the pair of poles that is fitted in the pole holding recessed portion.

3. The fender for ships according to claim 1, further comprising a connecting member that connects the wing portions and the ship to each other.

4. The fender for ships according to claim 1, wherein the rear buffer portion includes a first rear buffer portion and a second rear buffer portion having higher elasticity than the first rear buffer portion, and the first rear buffer portion and the second rear buffer portion are configured to contact rear surfaces of the wing portions of the structural body contact portion so as to support the wing portions when the ship is brought into contact with the pair of poles of the offshore structural body.

5. The fender for ships according to claim 1, wherein the rear buffer portion includes a first rear buffer portion made of a ring-shaped buffer member.

6. The fender for ships according to claim 5, wherein the ring-shaped buffer member is a rubber tire.

7. The fender for ships according to claim 5, wherein a second rear buffer portion is disposed inside the ring of the ring-shaped buffer member.

8. The fender for ships according to claim 1, wherein the ball joint portion includes:

a ball stud provided with a stud portion and a ball portion connected to the stud portion; and a socket configured to house the ball portion of the ball stud therein in a spherical surface contact state, and being tiltably connected to the ball stud.

9. The fender for ships according to claim 1, wherein the ship is a ship configured to make a non-self-cruising type ship cruise by pushing, and the structural body contact portion further includes: a center buffer portion disposed on a front surface of the center support portion, and end buffer portions disposed on outer end portions of the wing portions.

10. The fender for ships according to claim 9, wherein the end buffer portions are roller fenders.

11. A ship comprising the fender for ships according to claim 1.

12. The ship according to claim 11, wherein the ship is used for getting access to an offshore wind power generation facility and for allowing the ship to cruise to the offshore wind power generation facility by pushing.

13. A fender for ships configured to be mounted on a ship that makes a non-self-cruising type ship cruise by pushing, the fender for ships comprising:

a structural body contact portion configured to contact the non-self-cruising type ship;

a ball joint portion that supports the structural body contact portion on the ship; and a rear buffer portion disposed behind the structural body contact portion, wherein the structural body contact portion includes: a center support portion that is supported on the ship by the ball joint portion; wing portions that are rotatably disposed in a back and forth direction on left and right sides of the center support portion; a center buffer portion disposed on a front surface of the center support portion; and end buffer portions disposed on outer end portions of the wing portions.

* * * * *